US006908292B2

(12) United States Patent
Geus et al.

(10) Patent No.: US 6,908,292 B2
(45) Date of Patent: Jun. 21, 2005

(54) APPARATUS FOR PRODUCING A NONWOVEN WEB

(75) Inventors: Hans Georg Geus, Rheidt (DE); Hans Jürgen Hofemeister, Troisdorf-Spich (DE); Falk Rösner, Bonn (DE); Detlef Frey, Niederkassel (DE); Karsten Sievers, Köln-Dellbrück (DE); Udo Schomer, Urbach (DE)

(73) Assignee: Reifenhauser GmbH & Co. Maschinenfabrik, Troisdorf (DE)

( * ) Notice: Subject to any disclaimer, the term of this patent is extended or adjusted under 35 U.S.C. 154(b) by 216 days.

(21) Appl. No.: 10/294,480

(22) Filed: Nov. 14, 2002

(65) Prior Publication Data

US 2003/0113394 A1 Jun. 19, 2003

(30) Foreign Application Priority Data

Dec. 17, 2001 (EP) ..... 01129946

(51) Int. Cl.[7] ..... D01D 5/12

(52) U.S. Cl. ..... 425/72.2; 425/143; 425/169; 425/170; 425/377; 425/140

(58) Field of Search ..... 425/66, 72.2, 143, 425/144, 170, 378.1, 378.2, 379.1, 377, 169, 140

(56) References Cited

U.S. PATENT DOCUMENTS 3,936,253 A 2/1976 Fisher et al. ..... 425/72.2
5,098,636 A 3/1992 Balk ..... 264/555
5,599,488 A 2/1997 Profe ..... 264/40.3
5,645,057 A * 7/1997 Watt et al. ..... 128/206.12
5,730,821 A * 3/1998 Joest et al. ..... 156/167
5,766,646 A 6/1998 Geus ..... 425/72.2
5,800,840 A 9/1998 Geus ..... 425/7

FOREIGN PATENT DOCUMENTS

DE 4014414 11/1991
DE 4312419 10/1994

OTHER PUBLICATIONS

Patent Abstracts of Japan, vol. 2000, No. 01, Jan. 31, 2000 & JP 11 286823 (Teijin Ltd.) Oct. 19, 1999.

Patent Abstracts of Japan, vol. 1996, No. 02 (Feb. 29, 1996) & JP 07 268 721 (Teijin Seiki Co. Ltd.) Oct. 17, 1995.

Patent Abstracts of Japan, vol 2000, No. 19, 5 Junl 2001 & JP 2001 049526 (Toray Ind. Inc Feb. 20, 2001.

* cited by examiner

*Primary Examiner*—Benjamin Utech
*Assistant Examiner*—Joseph S. Del Sole
(74) *Attorney, Agent, or Firm*—Herbert Dubno

(57) ABSTRACT

In the production of a spunbond web by aerodynamically stretching thermoplastic filaments from a spinneret, the stretching nozzle is formed by two nozzle-forming units each of which has a temperature control device, especially a heater, to minimize deformation at the stretching nozzle defining wall. The result is a reduction in the tolerance of the basis weight of the spunbond web.

15 Claims, 2 Drawing Sheets

APPARATUS FOR PRODUCING A NONWOVEN WEB

FIELD OF THE INVENTION

Our present invention relates to an apparatus for producing a nonwoven web and, more particularly, a spunbond web from thermoplastic filament.

BACKGROUND OF THE INVENTION

In the production of nonwoven spunbond web, a spinning head produces a curtain of filaments by extrusion of the thermoplastic synthetic resin from a multiplicity of orifices. The filaments cool as they emerge from the spinneret and, along their path toward a collecting foraminous belt are stretched between two nozzle-forming units which can be referred to as stretching nozzle units. Together these units form a passage in which the filaments are aerodynamically stretched.

The filaments are collected on the foraminous belt and produce thereon a web in which the jumbled filaments are bonded together. In the stretching nozzle, i.e. the nozzle gap between the stretching nozzle units, the filaments are subjected to entrainment with process air which is at a temperature above the ambient temperature. The processing air, for example, may have a temperature of 35° to 45° C. while the ambient temperature may be around 20° C. The two units described may, of course, be combined into a single stretching nozzle by being connected together at their ends. The spinneret and the stretching nozzle can extend across the width of the foraminous belt and the lengths of the spinneret and the stretching nozzle across the foraminous belt may correspond to the width of the nonwoven web which is produced.

Between the spinning head and the stretching nozzle there is usually a cooling stretch or cooling device for the filament and a suction system may be provided beneath the belt to promote collection of the filament on the belt.

Between the stretching nozzle and the belt itself there may be provided a filament deposition device which ensures the jumbling or matting of the stretched filament and their bonding together.

Such apparatus had proved to be highly successful for the production of nonwoven spunbond webs, although heretofore it has been found that the weight per unit area of the web may vary across the web and over the length thereof significantly. Such tolerances may be of the order of ±20%.

Such high tolerances in the weight per unit area distribution are undesirable.

OBJECTS OF THE INVENTION

It is the principal object of the present invention to provide an improved apparatus for the production of spunbond with reduced weight per unit area tolerances.

Another object of this invention is to provide an apparatus which is capable of producing spunbond of greater uniformity than has heretofore been the case.

It is also an object of this invention to provide an apparatus which avoids the drawbacks of the apparatus previously described.

SUMMARY OF THE INVENTION

These objects and others which will become apparent hereinafter are attained, in accordance with the invention, in an apparatus for the production of spunbond which comprises a spinneret having a multiplicity of orifices through which a thermoplastic synthetic resin is extruded into a curtain of filaments, a filament drawing unit receiving the curtain of filaments and stretching the filaments, and a foraminous belt upon which the filaments are collected. According to the invention, the stretching nozzle unit has at least one temperature control device for regulating the temperature of the stretching nozzle assembly.

Where the stretching nozzle assembly comprises a pair of opposite stretching nozzle units together defining the gap in which the filaments are stretched, each of these units can have at least one temperature control device according to the invention. The temperature control device according to the invention can comprise a temperature control means at the back of the stretching nozzle unit, i.e. on a side thereof opposite the stretching gap, and adapted to control the temperature of that unit and thereby maintain gap uniformity across the width of the web and with time.

When reference is made herein to a temperature control device or unit, it should be noted that the unit will normally be a heated unit or element, although temperature control by cooling may also be used.

Preferably, therefore, the temperature control device for the stretching nozzle assembly is a heater for heating the nozzle or the units which form the nozzle. The heating device can use a heating fluid, electrical heating or any other form of heating. The heating device of the invention serves to compensate for the temperature difference between the temperature in the stretching nozzle gap or the process air temperature in the stretching nozzle gap and the ambient temperature and counteracts the deformation of the stretching nozzle unit and especially the parts thereof defining the gap which results from the temperature difference between the gap and the ambient air.

The invention is based upon our discovery that the nonuniformity in the web in terms of the variation in the weight per unit area thereof derives at least in part from a variation in the dimensions of the stretching nozzle gap which results from this temperature difference. In other words the undesired high weight per unit area tolerance of the web is a direct consequence of deformations in and bending of the stretching nozzle unit. By providing each of the elements defining the stretching nozzle unit with at least one heating device for heating same, the temperature differences within the stretching nozzle assembly can be compensated and the deformations avoided or reduced or compensated at least in major part to ensure a significantly more uniform web, at least in terms of weight per unit area thereof.

Normally the temperature in the stretching nozzle gap or the temperature of the process air in this gap is 35 to 45° C. higher than the ambient temperature (about 20° C.). As a result of this temperature difference, the stretching nozzle units defining the gap tend to bulge at their inner walls and this can be avoided by the aforementioned heating. Advantageously, the stretching nozzle unit is heated to the temperature in the nozzle gap itself.

According to the invention at least one temperature sensor is provided for measuring the ambient (environmental) temperature and a control device is provided for controlling the heating as a function at least in part of the measured ambient temperature. As has been indicated above, the ambient temperature is as a rule around 20° C. Preferably a temperature sensor is provided on the back of the stretching nozzle unit, i.e. the side thereof turned away from the stretching nozzle gap. A temperature sensor can especially be provided on a carrier element or girder along the back of the stretching nozzle unit and serving to support the latter.

In a particularly advantageous embodiment of the invention, on each of the stretching nozzle devices and preferably on the rear sides thereof at least one temperature sensor can be provided.

In a feature of the invention which has been found to be especially significant, a control and/or regulating device is provided for controlling and/or regulating the heating of the stretching nozzle assembly. When reference is made here to "control" of the heating of the stretching nozzle assembly, we intend to thereby indicate that the unit is brought to a particular temperature judged to be appropriate for obtaining a minimum variation in the weight per unit area parameter of the spunbond nonwoven web which is produced. When we refer to "regulation" of the temperature or the parameter, we intend to refer to the maintenance of the temperature which was selected by the control phase within narrow limits, by for example, a feedback measurement of that temperature, its comparison with a setpoint value and the generation of a correction signal.

According to the invention the controller which is provided and utilizes input of the temperature in the stretching gap and the ambient temperature and which also utilizes a measurement of the weight per unit area of the web across and along the latter as it is formed provides both control and regulation in the sense indicated.

According to a feature of the invention, therefore, a device is provided for detecting the weight per unit area of the spunbond web which is produced and the heating of the stretching nozzle system is controlled as a function of the detected weight per unit area. This parameter may also be controlled or regulated in the sense of the invention.

Advantageously, between the spinning head and the stretching nozzle at least one cooling device is provided. The cooling device can for example be a cooling chamber which in the horizontal plane can have a rectangular cross section, and can converge downwardly toward the aerodynamic stretching unit.

The aerodynamic stretching unit can be followed by a filament deposition device which provides a jumble of filaments on the foraminous belt, beneath which a suction source is provided to enable the filaments to deposit in randomly intertwined relationship to form a nonwoven spunbond mat. The mat deposition device can have the configuration of a jet pump with a Venturi-like intake at its upper end receiving the filaments from the stretching assembly. The mat deposition unit also can have a rectangular flow cross section in a horizontal plane and can converge to a constricted region from its intake opening. The intake opening may be open to the atmosphere to enable ambient air to be sucked in. The configuration of the deposition unit below the construction is that of a diffuser, i.e. a downwardly and outwardly flaring passage. The deposition region can be defined between two pairs of horizontal rollers disposed on opposite sides of the foraminous belt and the pairs of rollers may straddle the diffuser outlet.

The stretching nozzle itself may be configured as a gap nozzle with the gap having a rectangular cross section in a horizontal plane and the gap width being adjustable by enabling the two parts defining the gap to be moved toward and away from one another. The convergence of the gap in the direction in which the curtain of filaments passes therefrom can also be adjusted. At the outlet of the stretching nozzle a setback can be provided at least at one of the nozzle walls. The sides of the nozzle may be defined as box-like units with the nozzle wall configured from sheet metal. In other words in this embodiment a stretching nozzle unit may have sheet metal walls on the gap-defining side.

The invention is based upon our discovery that with the configuration of the stretching nozzle system in accordance with the invention, a heating of this unit can be effected in such manner that the variation in weight per unit area of the nonwoven spunbond web will be held to a minimum. The weight per unit area of a web, also known as the specific weight or the basis weight of the web can have, according to the invention, a variability in the basis weight of the order of ±6% or less as contrasted with a basis weight variability of ±20% with the prior art system.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
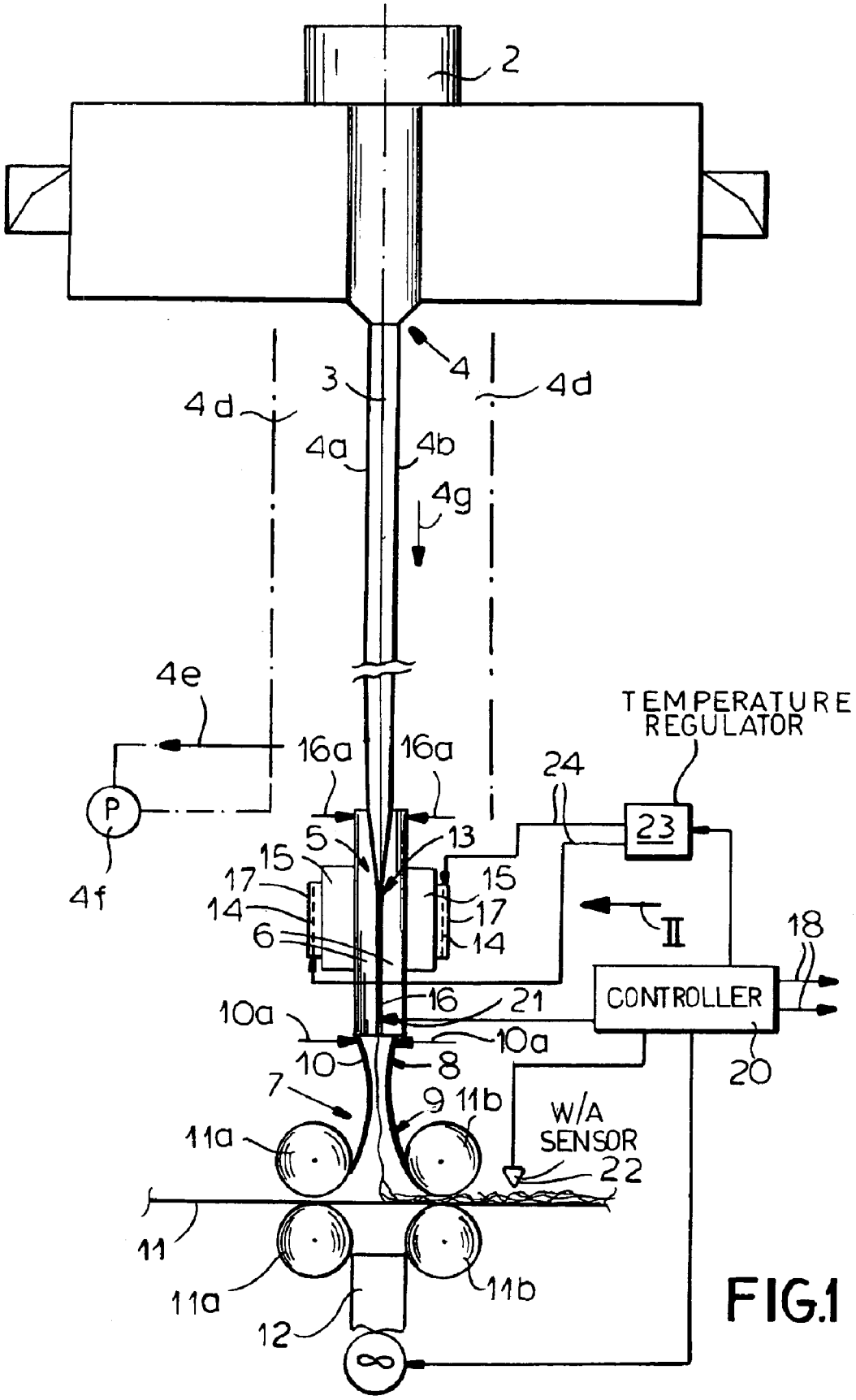
FIG. 1 is a diagram in part as a vertical cross section of an apparatus according to the invention.

In the drawing there is shown an apparatus for producing a spunbond nonwoven web 1 from aerodynamically stretched filaments of a thermoplastic synthetic resin. The apparatus comprises a spinning head 2 which produces, from a multiplicity of orifices, e.g. in a row extending perpendicular to the plane of the paper in FIG. 1 and hence across the width of the web, a curtain of synthetic resin monofilaments 3. The thread-forming compartment 4 is connected to the spinning head 2 in a conventional manner and further below the spinning head, a stretching nozzle 5 is provided for the aerodynamic stretching of the filaments or threads forming the curtain 3.

Flanking the curtain 3 in a cooling zone are a pair of perforated walls 4*a* and 4*b* which are supplied with cooling air in the direction of arrow 4*c* via plenums 4*d*, the air emerging from these plenums at 4, being referred to process air and being at an elevated temperature. The blower 4*f* which may be representative of a plurality of blowers, supplies this process air as the air for the aerodynamic stretching of the filaments.

The stretching nozzle 5 is formed by two opposing stretching nozzle units 6 defining the nozzle-forming gap between them.

Following the stretching nozzle 5, i.e. below it, is a mat-forming filament deposition unit or device 7 which has the configuration of a jet pump and is shaped with Venturi-like intake 8 and a diffuser outlet 9. The device 7 has air inlet openings at 10 receiving air from the surrounding free space as represented by the arrows 10*a* and which can be drawn into the device 7 by the Venturi action.

The web 1 is deposited on a sieve belt 11, i.e. a foraminous belt, beneath which a suction blower 12 is arranged to draw the randomly intertwining filaments onto the belt. Upstream and downstream of the discharge end 9 of the Venturi are pairs of rollers 11*a* and 11*b*, the downstream pair compressing the randomly deposited filament mat to effect bonding at contact sides.

The stretching nozzle 5 is of the configuration of a gap nozzle, i.e. a slit which is rectangular in a horizontal cross section extending the full width of the web and hence across the belt 11 perpendicular to the plane of the paper in FIG. 1.

The nozzle gap side inner walls 13 are convergent toward one another over the greater part of the vertical height of the nozzle. The stretching nozzle units 6 are connected together at their opposite ends in a manner not shown in the drawing.

Figure 2:
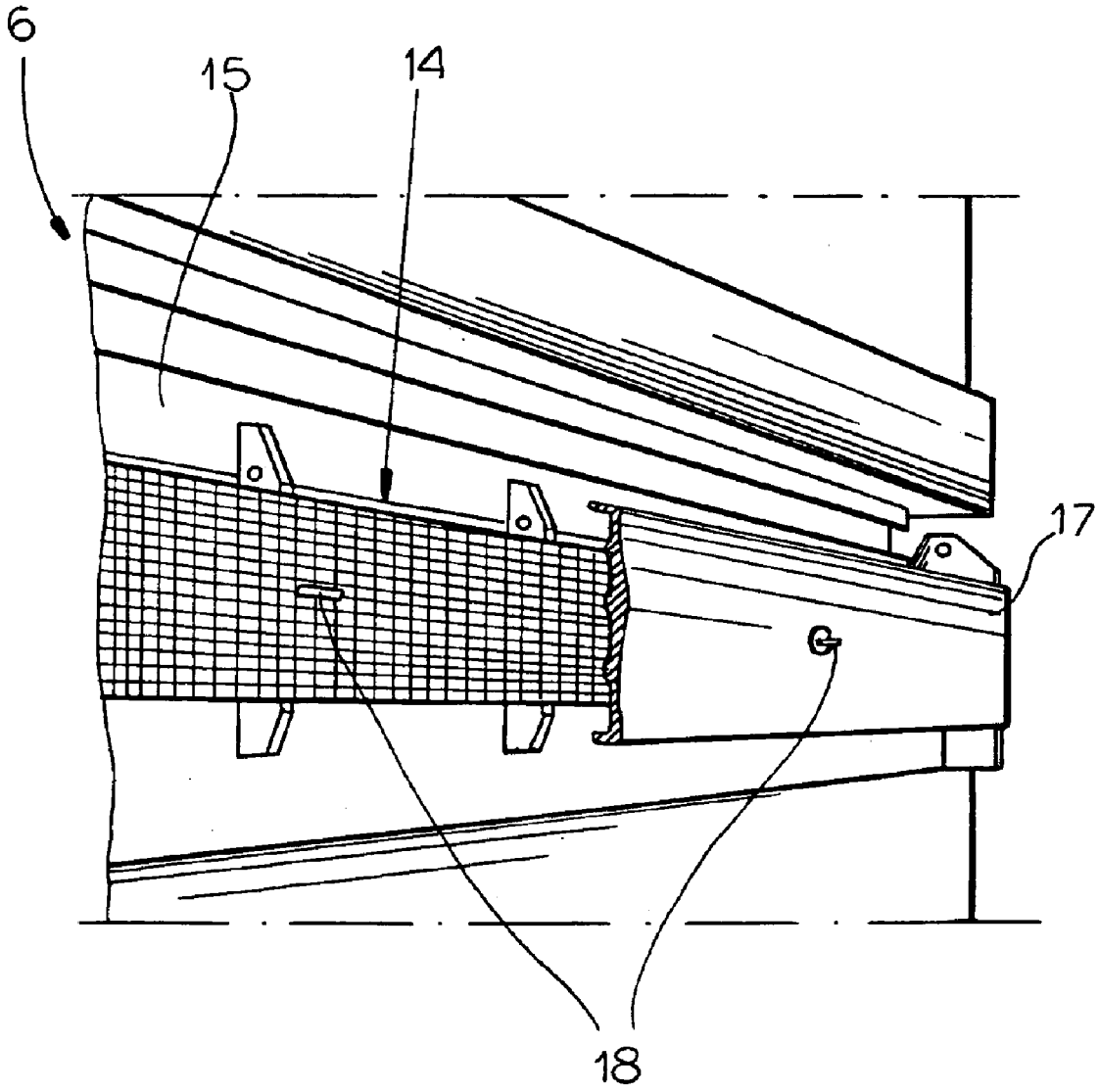
FIG. 2 is a perspective view, partly broken away and taken generally in the direction of the arrow II in FIG. 1 of a portion thereof.

According to the invention, these units are each provided with a heating device 14 which can be applied to a rear wall of the unit, i.e. a wall of the unit opposite that defining the nozzle gap (see FIG. 2).

Preferably each heating unit 14 is affixed to a support beam 15 of a respective stretching nozzle unit 6. The beams 15 run perpendicular to the travel direction 4*g* of the filaments. The heating devices 14 can, for example, be plate heaters or heating registers which can be electrically heated or heated by passage of a fluid therethrough.

In operation of the device there normally is a temperature difference between the temperature in the nozzle gap 16 or the process air temperature in the nozzle gap and ambient air temperature. The process air is supplied to the gap 16 as represented by the arrows 16*a* in FIG. 1.

The temperature in the nozzle gap can be for example 35 to 45° C. while the ambient temperature can be about 20° C. If this temperature difference is permitted to remain, the stretching nozzle units 6 deform and that deformation is noted especially at the inner walls 13 which can be formed from sheet metal and which is manifested as a bulging inwardly of these walls. The result is an undesirably high basis weight tolerance in the spunbond 1 which is produced. By using the heating devices 14, the temperature differences within the stretching nozzle units are compensated and thus deformations are eliminated.

From FIG. 2 it will be apparent that the rear side of each stretching nozzle unit 6 has a support beam 15 on which the respective heating unit 14 is mounted, the heating unit being covered by a thermally insulating plate 17. On this insulation temperature sensors 18 are provided to measure the ambient temperature. Turning to FIG. 1, it can be seen that the sensors 18 provide inputs for a controller 20 which also receives inputs represented at 21 from the inner walls 13 and representing the temperature in the nozzle gap or of the process air therein and an input 22 representing the basis weight of the spunbond. These inputs can be scanned across the width of the web if desired or can be derived from individual sensors spaced apart over the width of the web. The controller in response thereto operates a temperature regulator 23 to control the heating of the heaters 14 via outputs 24, e.g. by providing setpoint temperatures which are then maintained by feedback regulation.

We claim:

1. An apparatus for producing a spunbond web from aerodynamically stretched thermoplastic synthetic resin filaments, comprising:

a spinning head for producing a curtain of thermoplastic synthetic resin filaments;

a stretching nozzle defined between a pair of nozzle-forming units receiving said curtain of filaments and aerodynamically stretching said filaments;

a foraminous belt collecting aerodynamically stretched filaments in the form of a spunbond web;

a detector for measuring a basis weight of said web; and at least one temperature control device responsive to said detector for controlling the temperature of at least one of said units in response to the basis weight of said web.

2. The apparatus defined in claim 1 wherein each of said nozzle-forming units is provided with at least one of said temperature-control devices for controlling the temperature of said stretching nozzle.

3. The apparatus defined in claim 2 wherein said temperature-control devices are provided on back sides of the respective nozzle-forming units opposite sides thereof defining a gap in which said filaments are stretched.

4. An apparatus for producing a spunbond web from aerodynamically stretched thermoplastic synthetic resin filaments, comprising:

a spinning head for producing a curtain of thermoplastic synthetic resin filaments;

a stretching nozzle defined between a pair of nozzle-forming units receiving said curtain of filaments and aerodynamically stretching said filaments;

a foraminous belt collecting aerodynamically stretched filaments in the form of a spunbond web; and at least one temperature control device for controlling the temperature of at least one of said units to reduce basis weight tolerances in said web, each of said nozzle-forming units being provided with at least one of said temperature-control devices for controlling the temperature of said stretching nozzle, said temperature-control devices being provided on back sides of the respective nozzle-forming units opposite sides thereof defining a gap in which said filaments are stretched, each of said nozzle-forming units is provided along a back thereof with a respective support beam, the respective temperature control device being mounted on said beam.

5. The apparatus defined in claim 4 wherein each of said temperature-control devices is a heater for heating the respective unit.

6. The apparatus defined in claim 5, further comprising at least one temperature sensor responsive to ambient temperature and a controller for the respective heater responsive to said sensor.

7. The apparatus defined in claim 6, further comprising a device for regulating the temperature of said stretching nozzle by controlling said heater.

8. The apparatus defined in claim 7, further comprising a detector responsive to a basis weight of said web for controlling a temperature of said stretching nozzle.

9. The apparatus defined in claim 8, further comprising at least one cooling device between said spinning head and said stretching nozzle for cooling the filaments of said curtain.

10. The apparatus defined in claim 9, further comprising a mat-depositing device between said stretching nozzle and said foraminous belt.

11. The apparatus defined in claim 4, further comprising a controller for at least one of said devices for regulating the temperature of the respective unit in response to an ambient temperature.

12. The apparatus defined in claim 4, further comprising a controller responsive to a temperature of a gap in said stretching nozzle in which said filaments are stretched for maintaining a temperature of the respective unit preventing deformation thereof capable of inducing a basis weight change in said web.

13. The apparatus defined in claim 4, further comprising a sensor responsive to the basis weight of said web for controlling at least one of said devices.

14. The apparatus defined in claim 4, further comprising a cooling device between said spinning head and said stretching nozzle for cooling said filaments.

15. The apparatus defined in claim 4, further comprising a filament-depositing device between said stretching nozzle and said belt, said filament-depositing device being a jet nozzle with Venturi induction of air.

* * * * *